US005510820A

United States Patent [19]

Aulick et al.

[11] Patent Number: 5,510,820

[45] Date of Patent: Apr. 23, 1996

[54] DEVICE FOR INK REFILL OF A RESERVOIR IN A PRINT CARTRIDGE

[75] Inventors: Rodney O. Aulick, Louisville; Bradley L. Beach, Lexington; Terence E. Franey, Lexington; James M. Mrvos, Lexington; David G. Vella, Lexington, all of Ky.

[73] Assignee: Lexmark International, Inc., Greenwich, Conn.

[21] Appl. No.: 872,749

[22] Filed: Apr. 22, 1992

[51] Int. Cl.[6] ..... B41J 2/175

[52] U.S. Cl. ..... 347/85

[58] Field of Search ..... 346/140 R; 206/571, 206/564; 604/192, 239; 401/132, 133, 134; 347/85, 86, 87, 108

[56] References Cited

U.S. PATENT DOCUMENTS

| | | | |
|---|---|---|---|
| 3,098,482 | 7/1963 | O'Sullivan | 604/192 |
| 3,482,258 | 12/1969 | Steen | 346/140 R |
| 4,306,245 | 12/1981 | Kasugayama et al. | 346/140 R |
| 4,419,677 | 12/1983 | Kasugayama et al. | 346/140 R |
| 4,429,320 | 1/1984 | Hattori et al. | 346/140 R |
| 4,589,000 | 5/1986 | Koto et al. | 346/140 R |
| 4,641,154 | 2/1987 | Mikalsen | 346/140 R |
| 4,767,008 | 8/1988 | Warnecke et al. | 206/564 X |
| 4,771,295 | 9/1988 | Baker et al. | 346/1.1 |
| 4,929,109 | 5/1990 | Ikenaga | 401/134 |
| 4,967,207 | 10/1990 | Ruder | 346/140 R |
| 4,999,652 | 3/1991 | Chan | 346/140 R |
| 5,092,852 | 3/1992 | Poling | 604/192 |
| 5,098,391 | 3/1992 | Pantages et al. | 206/571 X |
| 5,199,470 | 4/1993 | Goldman | 346/140 R X |

FOREIGN PATENT DOCUMENTS

| | | | |
|---|---|---|---|
| 2709730 | 9/1978 | Germany | B41J 27/00 |
| 3401071 | 7/1985 | Germany | B41J 27/00 |
| 55-148168 | 11/1980 | Japan | B41J 3/04 |
| 57-125079 | 8/1982 | Japan | B41J 27/00 |
| 59-164148 | 9/1984 | Japan | B41J 3/04 |
| 0232872 | 12/1984 | Japan | 346/140 R |

OTHER PUBLICATIONS

*Webster's Ninth New Collegiate Dictionary*, 1990, p. 21, 575 & 808.

*Primary Examiner*—Benjamin R. Fuller
*Assistant Examiner*—David Yockey
*Attorney, Agent, or Firm*—Frank C. Leach, Jr.; John A. Brady

[57] ABSTRACT

An ink refill device includes a body having a chamber with ink therein. The chamber has one wall formed of a frangible material. The body has a needle communicating the chamber with a reservoir, which has a foam of a controlled porosity therein, in a print cartridge when the needle is inserted in a vent of the reservoir to fill the reservoir. Breaking of the frangible wall of the chamber with the needle extending downwardly enables ink to flow from the chamber at a controlled flow rate to the reservoir in the cartridge. In the preferred embodiment, the needle has one or more notched openings adjacent its distal end to increase its surface area through which ink flows to increase flow of ink to the reservoir.

16 Claims, 2 Drawing Sheets

DEVICE FOR INK REFILL OF A RESERVOIR IN A PRINT CARTRIDGE

FIELD OF THE INVENTION

This invention relates to a device for ink refill of a reservoir in a print cartridge of an ink jet printer and, more particularly, to a device in which the rate of flow of ink to the reservoir in the print cartridge is controlled.

BACKGROUND OF THE INVENTION

An ink jet printer has a removable print cartridge with a reservoir therein to hold a supply of ink to produce printing. When the ink in the reservoir is exhausted, it is necessary to replenish the supply of ink.

Instead of using a new print cartridge as a replacement to replenish the ink supply, it has previously been suggested to refill the reservoir in the print cartridge with ink. Previously suggested means for refilling the reservoir in the print cartridge include a squeeze bottle and a syringe having a movable plunger. Each of U.S. Pat. No. 4,419,677 to Kasugayama et al and U.S. Pat. No. 4,589,000 to Koto et al shows the use of a plunger in a syringe for refilling a reservoir of a print cartridge.

Each of the squeeze bottle and the plunger in the syringe has the disadvantage of requiring the user to exert a force to supply ink to the reservoir. Depending on the force exerted by the user, ink can flow too quickly for the porous material in the reservoir to absorb; this results in frequent overflow of ink. This ink overflow usually results in spillage and necessitates cleaning up the spillage. As a result, users are not favorably disposed towards using the previously suggested refill devices.

The reservoir of a print cartridge may be partially or completely filled with a porous material such as foam, for example, as shown in U.S. Pat. No. 4,771,295 to Baker et al and U.S. Pat. No. 4,999,652 to Chan. The use of the porous material creates a capillary action to cause ink to flow into the reservoir with the aforesaid Baker et al patent having a foam of a controlled porosity. The aforesaid Chan patent uses a complex arrangement for continuously supplying ink to the reservoir from a removable bottle.

SUMMARY OF THE INVENTION

The device of the present invention satisfactorily solves the foregoing problems of the ink flow rate being too high so as to create spillage. The device of the present invention obtains a controlled flow rate through eliminating any requirement for the user to apply any force to create ink flow from the refill device to the reservoir of the print cartridge as is required with the squeeze bottle or a syringe having a movable plunger.

The refill device of the present invention accomplishes this through permitting the ambient pressure to be applied to the ink in an ink supply chamber, which is partially filled with ink, of a body of the refill device by breaking a frangible seal forming at least a portion of a wall of the ink supply chamber in the body. Thus, the risk of spillage is significantly reduced so that a user does not seek to avoid using the refill device of the present invention.

An object of this invention is to provide a device for refilling a reservoir in a print cartridge of an ink jet printer.

Another object of this invention is to provide a device for controlling the ink flow rate during refilling of a reservoir in a print cartridge of an ink jet printer.

Other objects of this invention will be readily perceived from the following description, claims, and drawings.

DETAILED DESCRIPTION

Figure 1:
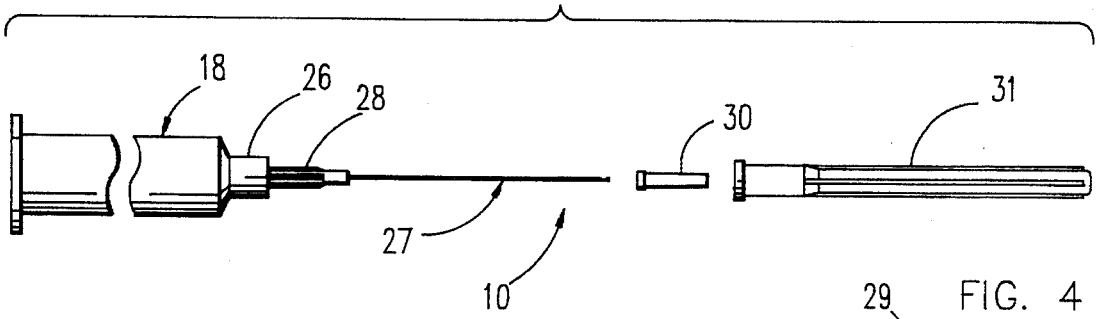
FIG. 1 is an exploded elevational view of an ink refill device of the present invention without any ink in a chamber of a body or a seal closing the open end of the chamber.

Referring to the drawings and particularly FIG. 1, there is shown an ink refill device 10 for refilling a reservoir 11 (see FIG. 9), which is partially or completely filled with a porous material such as a foam 12 of a controlled porosity, for example, in a print cartridge 14 of an ink jet printer 15. One suitable example of the ink jet printer 15 is an ink jet printer sold by Hewlett-Packard Co. as DeskJet 500 with the print cartridge 14 being Hewlett-Packard Part No. 51608A.

While the reservoir 11 is filled with the foam 12, it should be understood that the reservoir 11 can only be partially filled with the foam 12 or have no foam. The reservoir 11 is vented through a vent 15' in a top surface 16 of an upstanding portion 17 of the print cartridge 14.

Figure 5:
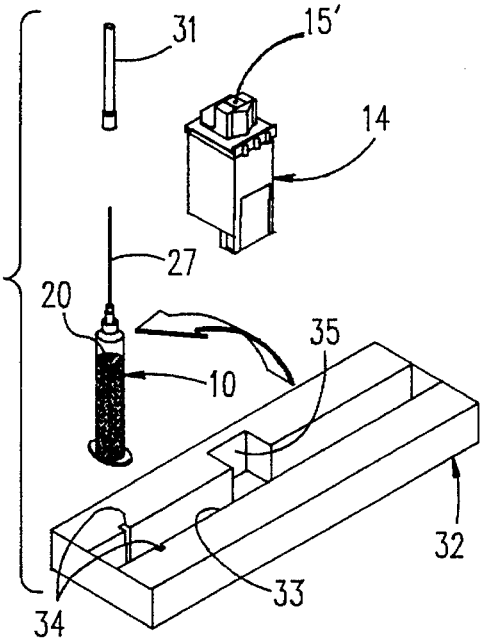
FIGS. 5–8 are schematic perspective views showing the steps for refilling a reservoir in a print cartridge of an ink jet printer with the refill device of the present invention.

The ink refill device 10 (see FIG. 2) includes a body 18 having a chamber 19 therein partially filled with ink 20 (see FIG. 5). When the reservoir 11 (see FIG. 9) has the foam 12 therein, the ink 20 (see FIG. 5) must be capable of coating the foam 12 (see FIG. 9).

Figure 2:
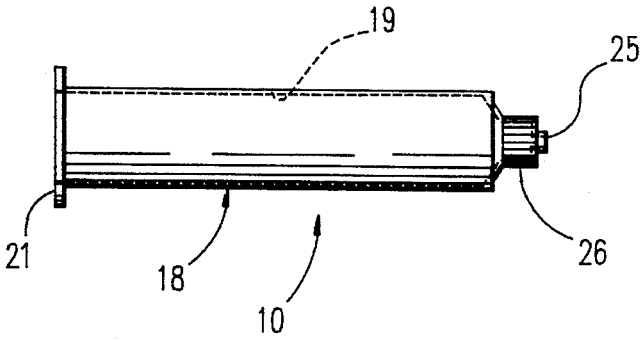
FIG. 2 is an elevational view of the body of the refill device of FIG. 1 without any ink in the chamber or the seal closing the open end of the body.

The body 18 (see FIG. 2) is formed of a material that is a barrier to vapor transmission to prevent the escape of vapor produced by the ink 20 (see FIG. 5) in the chamber 19 (see FIG. 2). One suitable example of the material of the body 18 is polypropylene.

Figure 3:
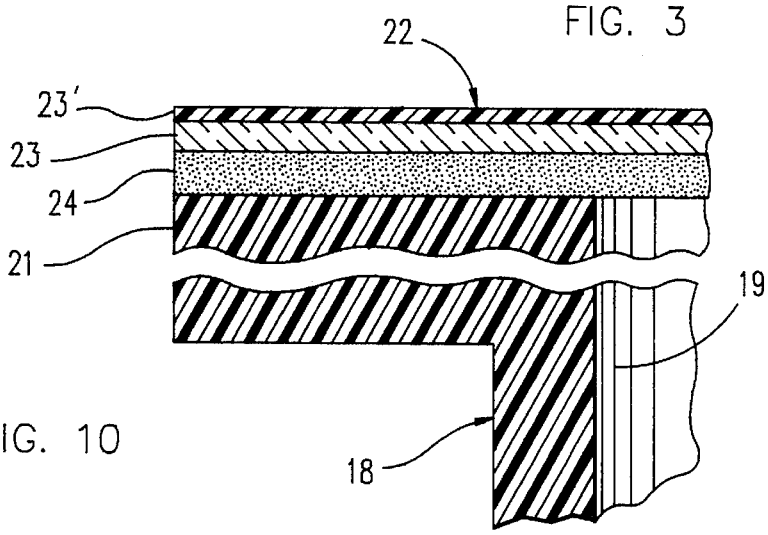
FIG. 3 is an enlarged fragmentary sectional view of a portion of the refill device of FIG. 1 showing the seal for the chamber of the body and a portion of the chamber.

One end of the body 18 has an enlarged flange 21 surrounding an open end of the chamber 19. The open end of the chamber 19 is sealed by a seal 22 (see FIG. 3).

The seal 22 includes an aluminum foil 23, which is substantially the same size and shape as the enlarged flange 21, having a polyester film 23' laminated to its outer surface to make the seal 22 stronger. The aluminum foil 23 is adhered to the surface of the flange 21 by a polypropylene adhesive 24 being heated. Thus, the seal 22 constitutes a wall of the chamber 19 and is frangible so that it can be easily broken such as by puncturing, for example. The seal 22 must be formed of a material that is not only easy to be broken but also resistant to the transfer of vapor to prevent escape of vapor from the ink 20 (see FIG. 5) in the chamber 19 (see FIG. 2).

Figure 4:
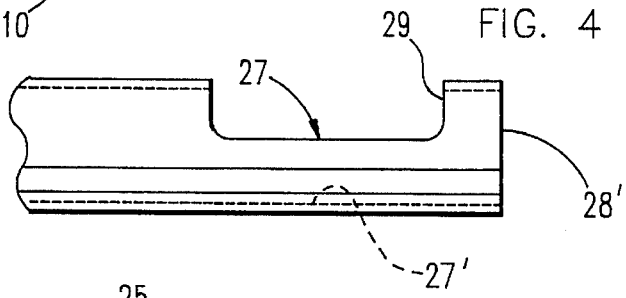
FIG. 4 is an enlarged fragmentary elevational view of a portion of a needle of the refill device of FIG. 1.

The other end of the body 18 has a hollow cylindrical tube 25 extending therefrom to enable the ink 20 (see FIG. 5) to flow from the chamber 19 (see FIG. 2) in the body 18. The tube 25 is surrounded by a hollow cylindrical portion 26 having a spiral thread in its inner surface for receiving a flange on the proximal end of a needle 27 (see FIG. 4), which has a longitudinal passage 27' extending therethrough, for attaching the needle 27 to the body 18 (see FIG. 1) in the well-known manner of attaching a hypodermic needle to a syringe so that the needle 27 communicates with the chamber 19 (see FIG.2) through the hollow cylindrical tube 25.

The needle 27 (see FIG. 4) is a hollow stainless steel tube, which can have an outer diameter of 1.27 millimeters and an inner diameter of about 1.07 millimeters to form the passage 27'. The needle 27 has a plastic hub 28 (see FIG. 1), which has the flange thereon, on the proximal end for disposition within the hollow cylindrical portion 26 to attach the needle 27 to the body 18 by the flange being disposed in the spiral thread in the inner surface of the hollow cylindrical portion 26.

The needle 27 has an opening 28' (see FIG. 4) at its distal end and preferably has at least one notched opening 29 along its length to increase the surface area exposed to the foam 12 (see FIG. 9) in the reservoir 11. The notched opening 29 (see FIG. 4) preferably ends about 0.5 millimeter from the tip or distal end of the needle 27. The notched opening 29 extends axially, preferably for two millimeters and inwardly to the centerline of the needle 27. While only the notched opening 29 has been shown, it should be understood that the opposite side of the surface area of the needle 27 could have a notched opening, similar to the notched opening 29, further from the tip or distal end of the needle 27 if desired.

Figure 9:
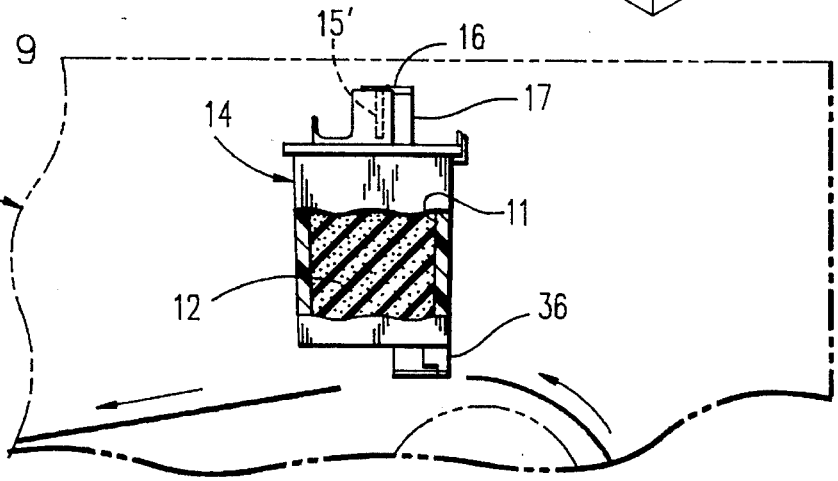
FIG. 9 is an elevational view, partly in section, of the print cartridge within a schematically shown ink jet printer.

When the needle 27 is to be inserted into the foam 12 (see FIG. 9), it is desired that the needle 27 (see FIG. 1) extend through about one-half of the thickness of the foam 12 (see FIG. 9). Thus, the length of the needle 27 (see FIG. 1) is dependent upon the thickness of the foam 12 (see FIG. 9). In one example, the effective length of the needle 27 (see FIG. 1) from the plastic hub 28 to the distal end of the needle 27 is between 36.5 millimeters and 39.5 millimeters. Since the foam 12 (see FIG. 9) fills slowly, the needle 27 (see FIG. 1) preferably is inserted into the foam 12 (see FIG. 9) to have the opening in the distal end of the needle 27 (see FIG. 4) and the notched opening 29 near the center of the foam 12 (see FIG. 9).

The needle 27 (see FIG. 1) has a cap 30 on its distal end or tip. The cap 30 is formed of a suitable plastic compatible with the ink. The cap 30 has a length sufficient to seal the opening 28' (see FIG. 4) in the tip or distal end of the needle 27 and the notched opening 29 and any additional notched opening in the needle 27.

The needle 27 has a cover 31 (see FIG. 1) extending over its entire exposed length. The cover 31 also overlies a portion of the plastic hub 28 of the needle 27.

Because the cover 31 does not have a seal with the plastic hub 28 of the needle 27, both the opening 28' (see FIG. 4) in the distal end of the needle 27 and the notched opening 29 in the needle 27 are exposed to ambient pressure. When the ambient pressure is a predetermined amount less than the ambient pressure existing within the chamber 19 (see FIG. 3) at the time that the seal 22 was applied to the body 18, a spray of the ink 20 (see FIG. 5) will escape from the chamber 19 (see FIG. 3). The escaping ink 20 (see FIG. 5) will be sprayed onto the interior of the cap 30 (see FIG. 1) so that none of the ink 20 (see FIG. 5) is sprayed onto the user at the time that the ink refill device 10 is employed.

The ink refill device 10 is assembled through the cap 30 (see FIG. 1) being initially disposed on the distal end of the needle 27. Next, the cover 31 is disposed over the cap 30 and the plastic hub 28 of the needle 27. The cover 31 has a press fit with the needle cap 30. Then, the needle 27 is attached to the body 18 through the flange on the plastic hub 28 being disposed in the spiral thread in the inner surface of the hollow cylindrical portion 26. Next, the chamber 19 (see FIG. 3) in the body 18 is partially filled with the ink 20 (see FIG. 5). Finally, the seal 22 (see FIG. 3) is applied through heating the polypropylene adhesive 24 to adhere the aluminum foil 23 to the enlarged flange 21 of the body 18 in a vapor sealing relation.

The ink refill device 10 (see FIG. 5) is shipped in a cardboard box or container 32 having a longitudinal groove 33 to receive the ink refill device 10. The box 32 has small cutouts 34 on opposite sides of the longitudinal groove 33 to receive the enlarged flange 21 (see FIG. 2) on the body 18.

Figure 6:
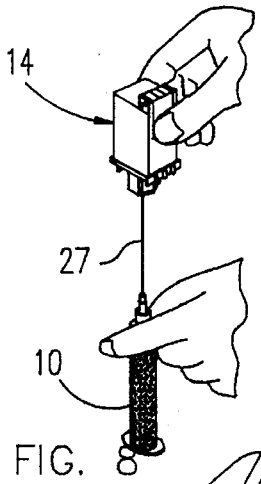

When the reservoir 11 (see FIG. 9) in the print cartridge 14 is to be refilled, the ink refill device 10 (see FIG. 5) is removed from the box 32 with the needle 27 extending upwardly. Then, the cover 31 is removed from the needle 27 along with the cap 30 (see FIG. 1), which is inside of the cover 31 and retained within the cover 31 by a press fit, being removed from the tip or distal end of the needle 27. As shown in FIG. 6, the print cartridge 14 is disposed with the top surface 16 (see FIG. 9) of the upstanding portion 17 inverted so that the vent 15' in the top surface 16 is facing downwardly to receive the needle 27 (see FIG. 6).

Figure 7:
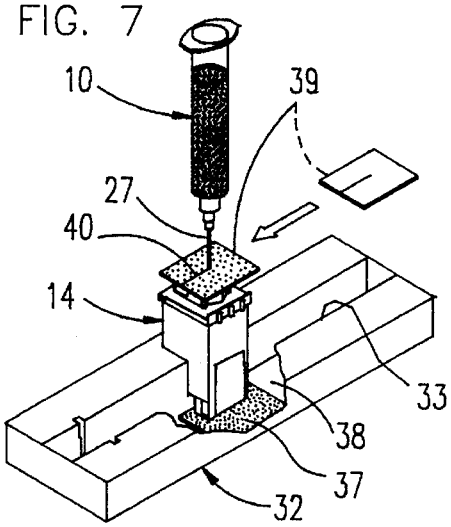

With the needle 27 communicating with the reservoir 11 (see FIG. 9) in the print cartridge 14 as shown in FIG. 6, the ink refill device 10 and the print cartridge 14 are inverted to have the print cartridge 14 beneath the ink refill device 10 as shown in FIG. 7. Then, the print cartridge 14 is disposed within a cutout 35 (see FIG. 5) in the box 32 as shown in FIG. 7. With the print cartridge 14 disposed in the cutout 35 (see FIG. 5) in the box 32, a printhead portion 36 (see FIG. 9) of the print cartridge 14 extends into the longitudinal groove 33 (see FIG. 7) in the box 32 so that the box 32 functions as a stand to support the print cartridge 14 with the needle 27 above the print cartridge 14.

The printhead portion 36 (see FIG. 9) rests on an absorbent pad 37 (see FIG. 7), which is adhered to a bottom surface 38 of the longitudinal groove 33. The absorbent pad 37 is formed of a polyester having an adhesive on its back surface for adhering to the bottom surface 38 of the longitudinal groove 33.

With the print cartridge 14 so disposed, an absorbent overflow pad 39, which is preferably formed of a polyester and has a slit 40 formed therein, is then disposed on the needle 27 through the slit 40 as shown in FIG. 7. The needle 27 is pulled slightly out of the print cartridge 14 prior to disposing the absorbent overflow pad 39 as shown in FIG. 7. Next, the ink refill device 10 is pushed down until the absorbent overflow pad 39 fits snugly against the top surface 16 (see FIG. 9) of the upstanding portion 17 of the print cartridge 14.

Figure 8:
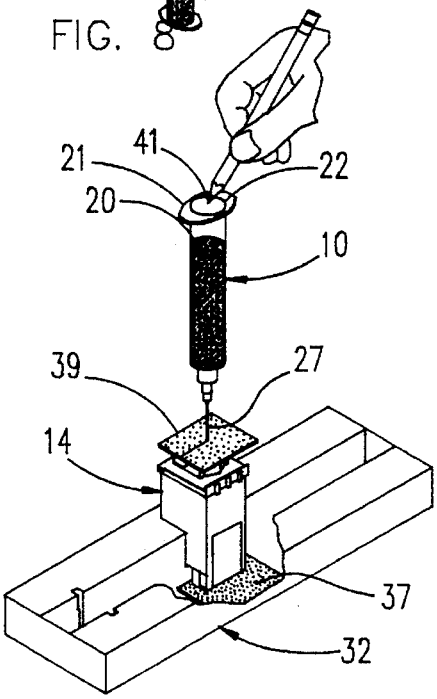

As shown in FIG. 8, the seal 22 is then broken by any suitable sharp object such as a pencil point 41, for example, piercing or puncturing a small hole in the seal 22. This vents the portion of the chamber 19 (see FIG. 2) in the body 18 not having the ink 20 (see FIG. 8) to the ambient so that the pressure is the same as the ambient pressure. This prevents any partial vacuum being created within the chamber 19 (see FIG. 2) to stop the flow of the ink 20 (see FIG. 8) to the reservoir 11 (see FIG. 9) by capillary action due to the foam 12 therein.

The size of the longitudinal passage 27' (see FIG. 4) in the needle 27 is not critical as the ink 20 (see FIG. 8) will pass through the longitudinal passage 27' (see FIG. 4) in the needle 27 after the seal 22 (see FIG. 8) is broken. However, the ink 20 is selected and formulated so that the capillary draw of the foam 12 (see FIG. 9) is sufficiently strong to accept all of the ink 20 (see FIG. 8), which leaves the needle 27.

After the reservoir 11 (see FIG. 9) in the print cartridge 14 is refilled, the opening in the seal 22 (see FIG. 8) is sealed by another seal (not shown) provided with the box 32. The needle 27 is then slowly removed from the print cartridge 14. Next, the cover 31 is positioned over the needle 27 with the cap 30 (see FIG. 1), which is retained within the cover 31 by a press fit, being disposed over the distal end of the needle 27.

After refilling is completed (This takes about ten minutes.), the print cartridge 14 (see FIG. 8) is removed from the box 32 and retained in the upright position shown in FIG. 8. The absorbent overflow pad 39 is manually employed to remove ink and debris from any area on the print cartridge 14 if needed. Next, the print cartridge 14 is reinstalled in the ink jet printer 15 (see FIG. 9). The ink refill device 10 (see FIG. 5) is then replaced in the longitudinal groove 33 in the box 32, and the box 32 discarded.

It should be understood that the foam 12 (see FIG. 9) in the reservoir 11 absorbs less and less of the ink 20 (see FIG. 8) after several refills. The excess ink is absorbed by the absorbent overflow pad 39. When the absorbent overflow pad 39 has an ink spot larger than twenty-five millimeters in width or the absorbent overflow pad 39 is covered with ink, the print cartridge 14 should not be refilled again.

Figure 10:
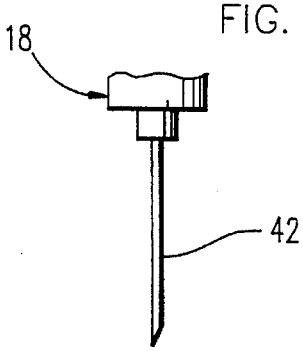
FIG. 10 is an elevational view of a tapered needle used in place of the notched needle of FIGS. 1 and 4.

Instead of using the needle 27 (see FIG. 4) with the notched opening 29 therein, a needle 42 (see FIG. 10) having a tapered end may be employed. The needle 42 would have an opening only at its distal end or tip of the needle 42. The tapered end of the needle 42 provides a larger surface area for capillary action to occur within the foam 12 (see FIG. 9) than a straight needle.

While the ink refill device 10 (see FIG. 1) has been shown and described as being used with the reservoir 11 (see FIG. 9) having the foam 12, it should be understood that the ink refill device 10 (see FIG. 1) may be employed with a reservoir having no foam. The ink 20 (see FIG. 8) would flow solely by gravity into the reservoir 11.

An advantage of this invention is that it extends the economic life of a print cartridge of an ink jet printer. Another advantage of this invention is that it avoids any requirement for the application of force by a user that can cause too high of a flow rate to produce leakage. A further advantage of this invention is that the rate of filling a reservoir in a print cartridge of an ink jet printer is controlled. Still another advantage of this invention is that it reduces the risk of ink spillage when refilling a reservoir in a print cartridge of an ink jet printer.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An ink refill device for refilling an ink reservoir in a print cartridge of an ink jet printer with ink through a continuously open vent of the reservoir including:

a body having a chamber therein, said chamber having an amount of the ink therein to partially fill said chamber so that said chamber has one portion with the ink therein and another portion having none of the ink therein;

said chamber having inner surfaces, said inner surfaces of said one portion of said chamber being contacted by the ink;

said chamber having a substantially constant volume irrespective of the amount of the ink therein at any time;

said body having a needle always communicating with said chamber so that said needle has the ink therein when said one portion of said chamber has the ink therein, said needle extending from said body for communication with a reservoir of a print cartridge to refill the reservoir through the continuously open vent with the ink;

said chamber having a substantially flat first wall and a plurality of additional walls, said substantially flat first wall and said plurality of additional walls constituting all of said walls of said chamber, said substantially flat first wall of said chamber being at an end of said chamber remote from said needle;

means for selectively enabling communication of an ambient with said another portion of said chamber so that said another portion of said chamber is at a pressure of the ambient when the ink flows from said chamber to prevent creation of any partial vacuum within said chamber and to enable the ink to flow from said chamber without any force exerted by a user on said chamber or the ink therein;

said selectively enabling means including said substantially flat first wall formed of a material that is more frangible than said plurality of additional walls of said chamber so that said substantially flat first wall can be selectively and readily broken in said another portion of said chamber having none of the ink therein to enable said another portion of said chamber to be at a pressure of the ambient;

and said substantially flat first wall of said chamber being capable of being broken by a pencil.

2. The device according to claim 1 including:

each of said body and said chamber having a cylindrical shape;

said substantially flat first wall being in a plane;

said body having an enlarged flange substantially in the plane of said substantially flat first wall;

and said substantially flat first wall and said enlarged flange having substantially coplanar surfaces.

3. In combination:

a print cartridge for use in an ink jet printer having a reservoir with liquid ink refillable through a continuously open vent of the print cartridge;

a body having a chamber, said chamber having the ink therein to partially fill said chamber;

a needle supported by said body and communicating with the ink therein;

said needle having an outer surface of a size to enter the continuously open vent of the print cartridge;

and a box having:

a longitudinal groove therein to receive said body and said needle when refilling the reservoir in the print cartridge with the ink is not occurring, said longitudinal groove having a bottom surface supporting at least said body;

and a receptacle communicating with said longitudinal groove, said receptacle having a bottom surface supporting the print cartridge with said needle in the continuously open vent and said chamber above the print cartridge for filling of the reservoir in the print cartridge.

4. The combination according to claim 3 including:

said chamber having one portion with the ink therein and another portion having none of the ink therein;

said chamber having a first wall and a plurality of additional walls constituting all of said walls of said chamber;

and at least a portion of said first wall of said chamber formed of a material that is more frangible than said plurality of additional walls of said chamber so that at least said portion of said first wall can be selectively and readily broken in said another portion of said chamber having none of the ink therein to enable said another portion of said chamber to be at a pressure of the ambient when said box supports the print cartridge with said chamber above the print cartridge and at least said portion of said first wall broken to have the ink flow from said chamber without any force exerted by a user on said chamber or the ink therein.

5. The combination according to claim 3 in which:

said chamber has one portion with the ink therein and another portion has none of the ink therein;

said chamber has a first wall and a plurality of additional walls constituting all of said walls of said chamber;

and said first wall of said chamber is formed of a material that is more frangible than said plurality of additional walls of said chamber so that said first wall can be selectively and readily broken in said another portion of said chamber having none of the ink therein to enable said another portion of said chamber to be at a pressure of the ambient when said box supports the print cartridge with said chamber above the print cartridge and said first wall broken to have the ink flow from said chamber without any force exerted by a user on said chamber or the ink therein.

6. The combination according to claim 5 including:

said needle having a distal end;

said needle having one or more open areas adjacent said distal end through which the ink flows;

a removable cap overlying said one or more open areas of said needle adjacent said distal end for receiving any of the ink escaping from said needle prior to use;

and said removable cap including a body having a closed end and an open end to receive said needle so that said body of said removable cap overlies said one or more open areas of said needle, said removable cap having to be removed from overlying said needle for said needle to be used.

7. The combination according to claim 6 including:

said needle having a hub adjacent said body for enabling attachment of said needle to said body;

and a removable cover overlying said cap and said needle in an overlying position prior to use, said cover cooperating with said hub to retain said cover in said overlying position.

8. The combination according to claim 5 including:

said needle having a distal end;

said needle having an opening at said distal end for flow of the ink from said needle;

said needle having a longitudinal axis;

said needle having one or more notched surface areas adjacent said distal end to also allow the ink in said chamber to flow therethrough, said one or more notched surface areas being substantially larger then said opening and extending to substantially said longitudinal axis of said needle;

a removable cap overlying said opening of said needle and said one or more notched surface areas of said needle for receiving any of the ink escaping from said needle prior to use;

said removable cap including a body having a closed end and an open end to receive said needle so that said body of said removable cap overlies said opening and said one or more notched surface areas of said needle, said removable cap having to be removed from overlying said needle for said needle to be used;

said needle having a hub adjacent said body for enabling attachment of said needle to said body;

and a removable cover overlying said cap and said needle in an overlying position prior to use, said cover cooperating with said hub to retain said cover in said overlying position.

9. The combination according to claim 5 including:

said needle having a tapered distal end;

said tapered distal end of said needle having a single opening for flow of the ink from said needle;

a removable cap overlying said single opening of said needle for receiving any of the ink escaping from said needle prior to use;

said removable cap including a body having a closed end and an open end to receive said needle so that said body of said removable cap overlies said single opening of said needle, said removable cap having to be removed from overlying said needle for said needle to be used;

said needle having a hub adjacent said body for enabling attachment of said needle to said body;

and a removable cover overlying said cap and said needle in an overlying position prior to use, said cover cooperating with said hub to retain said cover in said overlying position.

10. The combination according to claim 3 including:

said needle having a distal end;

said needle having one or more open areas adjacent said distal end through which the ink flows;

a removable cap overlying said one or more open areas of said needle adjacent said distal end for receiving any of the ink escaping from said needle prior to use;

and said removable cap including a body having a closed end and an open end to receive said needle so that said body of said removable cap overlies said one or more open areas of said needle, said removable cap having to be removed from overlying said needle for said needle to be used.

11. The combination according to claim 10 including:

said needle having a hub adjacent said body for enabling attachment of said needle to said body;

and a cover overlying said cap and said needle in an overlying position, said cover cooperating with said hub to retain said cover in said overlying position.

12. The combination according to claim 3 including:

said needle having a distal end;

said needle having an opening at said distal end for flow of the ink from said needle;

said needle having a longitudinal axis;

said needle having one or more notched surface areas adjacent said distal end to also allow the ink in said chamber to flow therethrough, said one or more notched surface areas being substantially larger then said opening and extending to substantially said longitudinal axis of said needle;

a removable cap overlying said one or more notched surface areas of said needle adjacent said distal end and said opening at said distal end of said needle for receiving any of the ink escaping from said needle prior to use;

said removable cap including a body having a closed end and an open end to receive said needle so that said body of said removable cap overlies said one or more notched surface areas of said needle and said opening at said distal end of said needle, said removable cap having to be removed from overlying said needle for said needle to be used;

said needle having a hub adjacent said body for enabling attachment of said needle to said body;

and a removable cover overlying said cap and said needle in an overlying position prior to use, said cover cooperating with said hub to retain said cover in said overlying position.

13. The combination according to claim 3 including:

said needle having a tapered distal end;

said tapered distal end of said needle having a single opening for flow of the ink from said needle;

a removable cap overlying said single opening of said needle adjacent said tapered distal end for receiving any of the ink escaping from said needle prior to use;

said removable cap including a body having a closed end and an open end to receive said needle so that said body of said removable cap overlies said single opening of said needle, said removable cap having to be removed from overlying said needle for said needle to be used;

said needle having a hub adjacent said body for enabling attachment of said needle to said body;

and a removable cover overlying said cap and said needle in an overlying position prior to use, said cover cooperating with said hub to retain said cover in said overlying position.

14. The combination according to claim 3 in which said bottom surface of said receptacle is disposed above said bottom surface of said longitudinal groove so that only a portion of the print cartridge rests on said bottom surface of said receptacle.

15. The combination according to claim 14 in which:

said body has an end remote from said needle;

said body has an enlarged flange adjacent said end of said body remote from said needle;

said enlarged flange being larger than said body;

and said longitudinal groove in said box has cutouts on opposite sides to receive portions of said enlarged flange larger than said body.

16. The combination according to claim 3 in which:

said body has an end remote from said needle;

said body has an enlarged flange adjacent said end of said body remote from said needle;

said enlarged flange being larger than said body;

and said longitudinal groove in said box has cutouts on opposite sides to receive portions of said enlarged flange larger than said body.

* * * * *